US008251441B2

(12) United States Patent
Alink

(10) Patent No.: US 8,251,441 B2
(45) Date of Patent: Aug. 28, 2012

(54) CHAIR

(76) Inventor: Barbara Elisabeth Alink, Vancouver (CA)

( * ) Notice: Subject to any disclaimer, the term of this patent is extended or adjusted under 35 U.S.C. 154(b) by 0 days.

(21) Appl. No.: 12/805,814

(22) Filed: Aug. 20, 2010

(65) Prior Publication Data

US 2012/0043788 A1 Feb. 23, 2012

(51) Int. Cl.
*A47C 13/00* (2006.01)
*A47D 1/04* (2006.01)

(52) U.S. Cl. ... 297/1; 297/312; 297/440.14; 297/452.36

(58) Field of Classification Search ..... 297/1, 3, 297/440.14, 452.36, 284.9, 312
See application file for complete search history.

(56) References Cited

U.S. PATENT DOCUMENTS

| | | | | |
|---|---|---|---|---|
| 1,976,326 | A * | 10/1934 | Carlton | 297/312 X |
| D143,466 | S | 1/1946 | Cowan | |
| D144,404 | S | 4/1946 | Mabry | |
| D147,581 | S | 9/1947 | Coulter | |
| 3,556,586 | A | 1/1971 | Beardmore | |
| 3,897,104 | A | 7/1975 | Black | |
| 4,092,041 | A | 5/1978 | Landry et al. | |
| 4,241,949 | A | 12/1980 | Parker | |
| 4,278,288 | A | 7/1981 | Thebaud | |
| 4,585,272 | A | 4/1986 | Ballarini | |
| 4,711,492 | A | 12/1987 | Asbjornsen et al. | |
| 5,195,804 | A | 3/1993 | Stolle et al. | |
| 5,415,454 | A * | 5/1995 | Fu-Tsung | 297/3 |
| 5,577,811 | A | 11/1996 | Ogg | |
| 5,690,379 | A * | 11/1997 | Cayssials | 297/1 |
| 5,887,946 | A | 3/1999 | Raftery | |
| 6,139,109 | A * | 10/2000 | Lajoie | 297/452.36 |
| 7,632,191 | B2 | 12/2009 | Zambelli et al. | |
| 2009/0102264 | A1 | 4/2009 | Fischer et al. | |

FOREIGN PATENT DOCUMENTS

| | | |
|---|---|---|
| DE | 1118414 | 11/1961 |
| DE | 3422038 | 12/1985 |
| EP | 0 537 839 | 4/1993 |
| WO | WO 2005/117652 | 12/2005 |

* cited by examiner

*Primary Examiner* — Anthony D Barfield

(57) ABSTRACT

Disclosed is a chair comprising a seat, a base, a pair of parallel spaced apart uprights extending from the base positioned to opposed sides of the spine of a user seated on the chair, the uprights supporting the seat and a body support member extending from each upright in opposed directions, said body support members being substantially parallel to the back of said user. Each body support members may integrally formed with an upright with have an arcuate portion therebetween. The chair may further comprise first and second pairs of body support members and be rotatable between first and second orientations in which either the first or second body support members may form the seat or back support for the user.

8 Claims, 6 Drawing Sheets

CHAIR

BACKGROUND OF THE INVENTION

1. Field of Invention

The present invention relates to chairs in general and in particular to a chair adapted to support and massage the back muscles of a user at one of a plurality of positions.

2. Description of Related Art

Chairs are common seating implements which commonly include a raised seating surface and a back rest or support. Chairs are used to support a user for working at a desk, table or the like or for relaxing. One common difficulty with conventional chairs is that their use may place stress or strain on the back of the user.

Stress or strain on the back of a user sitting in a chair may be due to the unnatural angles at which the back of the user is supported. Examples may be found in chairs that have backs which are too upright thereby forcing the user to support themselves at too steep of an angle of inclination or even vertically in some cases.

An additional source of stress or strain on the back of the user is due to the surface of the chair itself and the pressures it exerts upon the back of the user during use. In particular, many chairs include a hard surface. Such hard surfaces are known to cause pressure points leading to soreness and pain in the user. This is particularly the case the hard surface is rested against by the spine of the user.

Applicant is aware of previous attempts to provide a chair having a contact relieving portion in the middle of the back rest. Such attempts however have provided parallel panels which are rotatable or bend about a horizontal axis. In such devices however, the panels are often cantilevered from a bottom most portion and may therefore be prone to twisting about an axis parallel to the back of the user. Accordingly, such devices may upon application of pressure from the back of the user, be rotate about such an axis in a direction which reduces pressure of the panel on the muscles of the user adjacent to the spine. Examples of such devices may be found, in U.S. Pat. No. 5,577,811 to Ogg.

SUMMARY OF THE INVENTION

According to a first embodiment of the present invention there is disclosed a chair comprising a seat, a base, a pair of parallel spaced apart uprights extending from the base positioned to opposed sides of the spine of a user seated on the chair, the uprights supporting the seat and a body support member extending from each upright in opposed directions, the body support members being substantially parallel to the back of the user.

Each body support member may extend from the upright to a free distal end. Each body support member may be substantially planar. Each body support member may integrally formed with the upright.

Each body support member and upright may have an arcuate portion therebetween. The arcuate portion may have a radius of curvature of between 0.4 and 2.4 inches at a surface which supports a user.

The uprights may comprise vertical plates. The chair may further comprise first and second pairs of body support members. The first pair of body support members may form a seat portion and the second pair of body support members may form a back support for the user.

The uprights and first and second body support members may be rotatable between first and second orientations. In the first orientation the first body support member forms a seat and the second body support members form the back of the chair. In the second orientation the second body support members form a seat and the first body support members form the back of the chair.

The first and second body supports may have an angle of 100 degrees therebetween. The base may comprise planar members oriented perpendicularly to the uprights. The base may comprise a first set of legs for supporting the chair in the first orientation and a second set of legs for supporting the chair in the second orientation.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
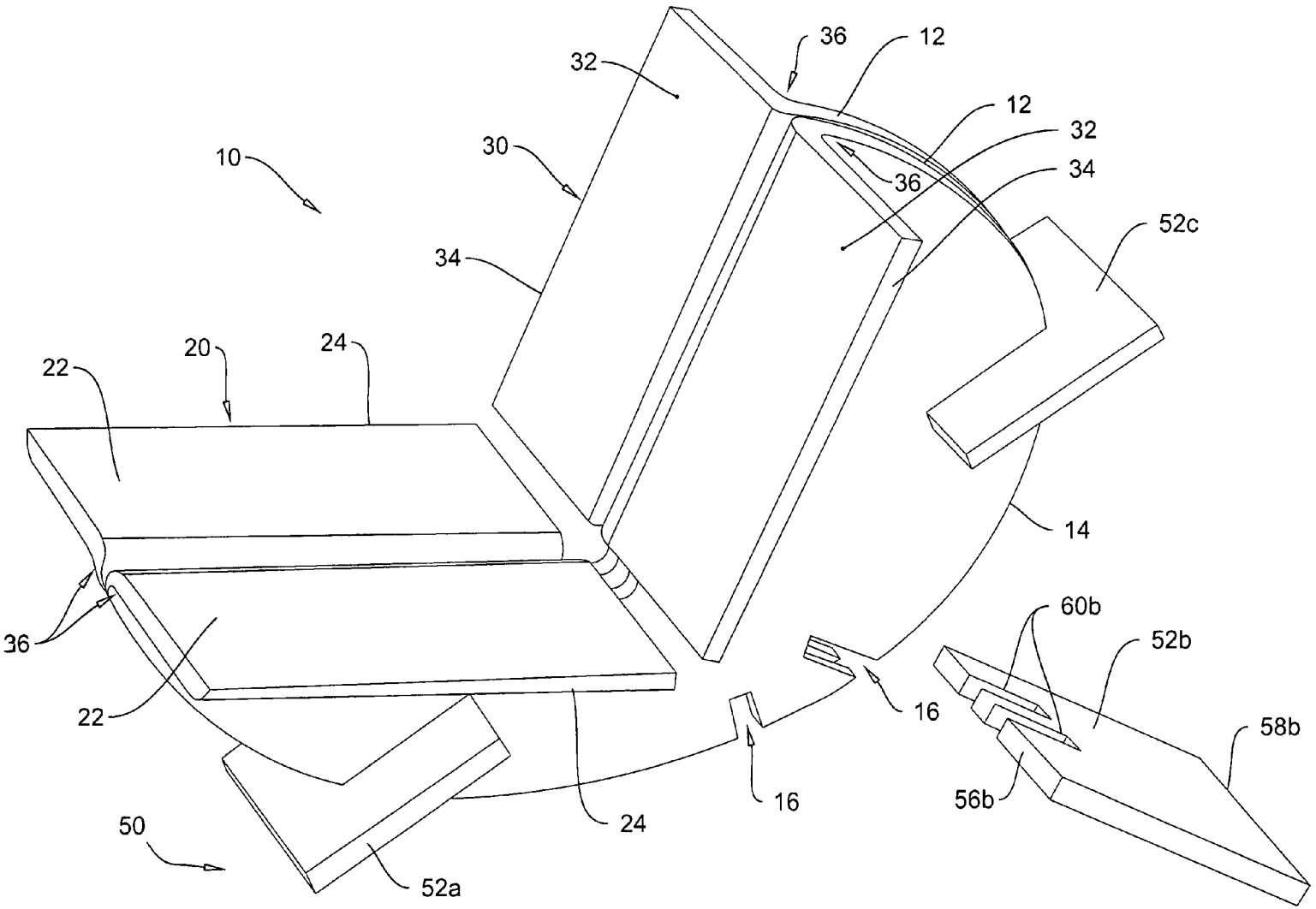
FIG. 1 is a perspective view of a chair according to a first embodiment of the present invention.

Referring to FIG. 1, a chair according to a first embodiment of the invention is shown generally at 10. The chair 10 comprises and a pair of parallel spaced apart uprights 12 supporting seat and back portions, 20 and 30, respectively and a base 50 supporting the uprights.

The uprights 12 are formed of substantially planar members having an outline 14. As illustrated, the uprights 12 may have an egg-shaped curved outline 14, although it will be appreciated that other outline shapes may be useful as well, such as, by way of non-limiting example, circular, rectangular, triangular, polygonal, oval or irregular. The uprights 12 include a plurality of upright slots 16 therein for receiving base members 52 into as will be more fully described below. The uprights 12 are arranged in parallel spaced apart relation to each other having a gap distance generally indicated at 80 in FIG. 3.

Figure 4:
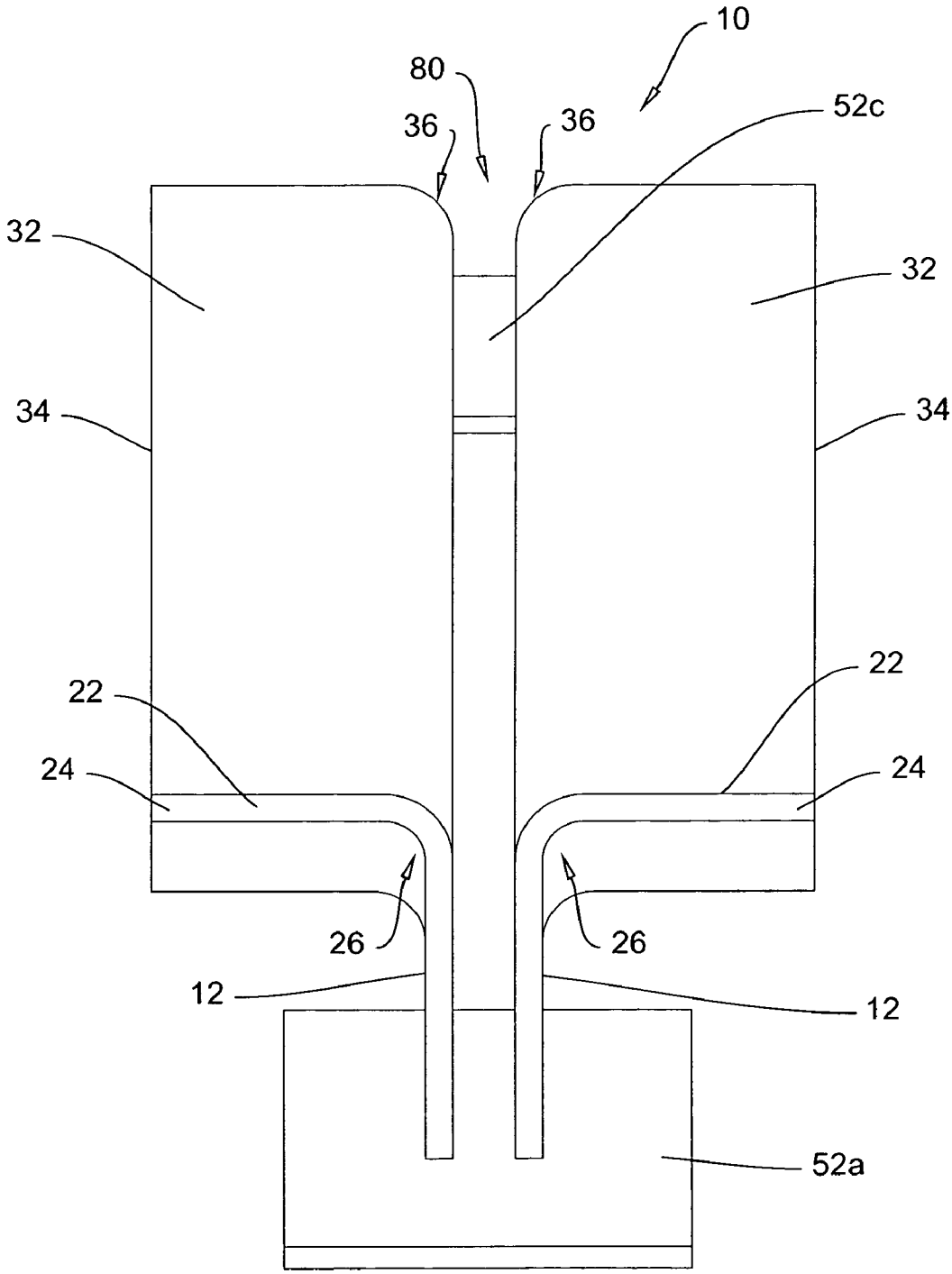
FIG. 4 is a front elevational view of the chair of FIG. 1.
Figure 5:
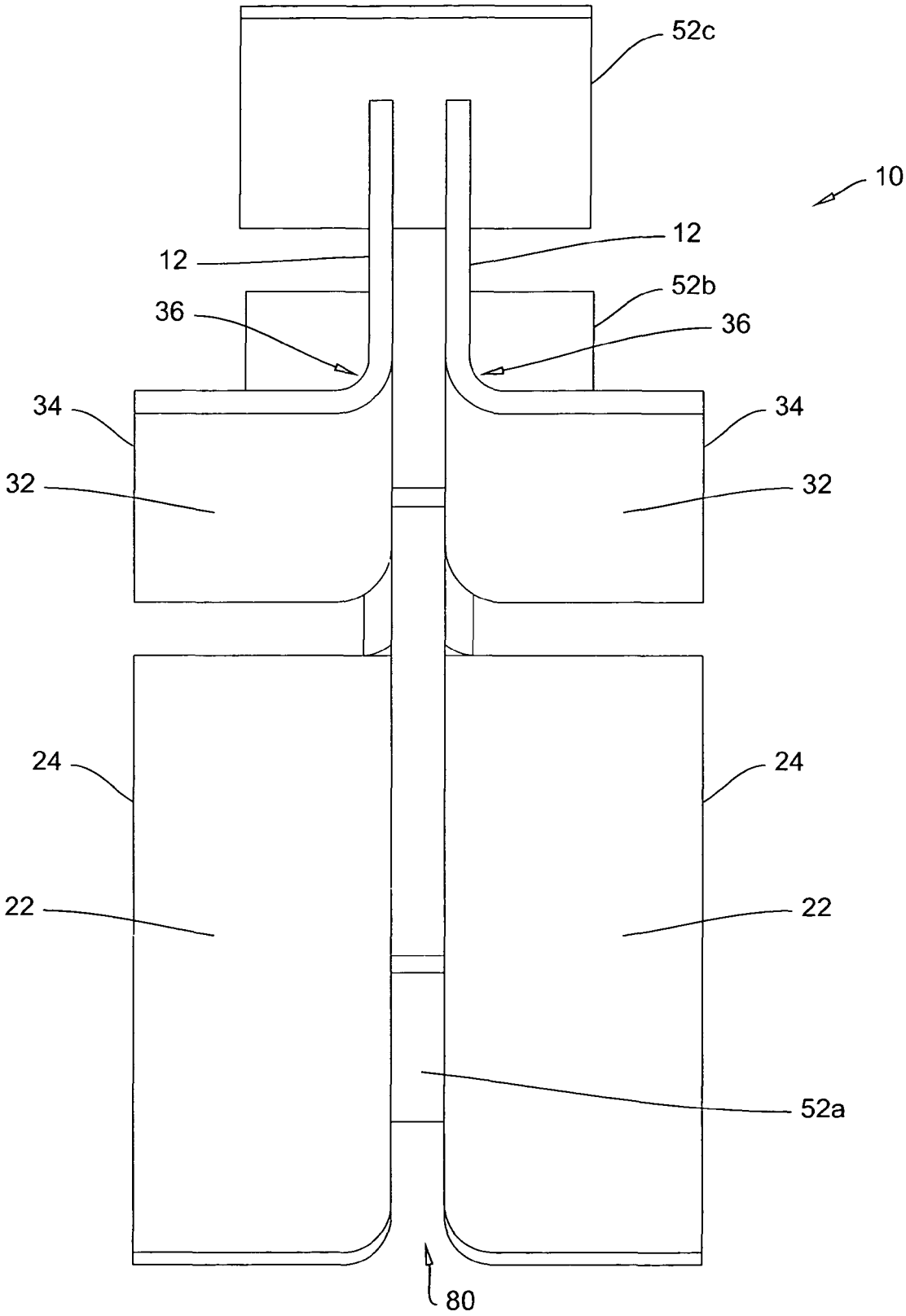
FIG. 5 is a top plan view of the chair of FIG. 1.

The base 50 comprises a plurality of planar base members 52*a*, 52*b*, and 52*c* extending perpendicularly from the uprights. With reference to the second base ember 52*b* by way of example, each base member 52*b* has a substantially planar outline extending between first and second ends, 56*b* and 58*b*, respectively and includes a pair of base slots 60*b* extending into the first end 56*b*. Each of the first and third base members 52*a* and 52*c* may include similar base slots for locating within a desired upright slot. The base slots 60*b* are sized and positioned such that the base slots and upright slots 16 intermesh so as to affix the planar member to the uprights. As illustrated in FIGS. 4 and 5, the base members 52*a*, 52*b* and 52*c* have a width that is less than the width of the seat and back portions 20 and 30. Having a relatively narrow width base encourages the user to use their legs to maintain when seated in the chair 10 so as to maintain the hips of the user in a more natural position as opposed to crossed which can impart stresses to the hips and lower back. In particular, the width of the first and third base members 52*a* and 52*c* may be selected to be between 3.9 and 7.9 inches (100 and 200 mm) wide and the second base member 52*b* may be selected to have a width of between 7.9 and 15.7 inches (200 and 400 mm) so as to provide greater stability to the rear of the chair.

The uprights slots 16 of each upright 12 are aligned with each other such that a base member located therein will extend perpendicularly across both uprights. The upright slots 16 and base slots 60*b* may be sized so as to receive the corresponding upright or base member therein in a friction or interference fit thereby providing a rigid connection between the uprights and the base members. Optionally, one or more of the base members 52*a*, 52*b* or 52*c* may be secured into the uprights by means of a fastener, adhesive or by permanent means such as welding although it will be appreciated that the fastening means utilized to secure the second base member 52*b* may be removable so as to permit the second base member 52*b* to be moved between different upright slots 16 as described below for different positions.

Figure 2:
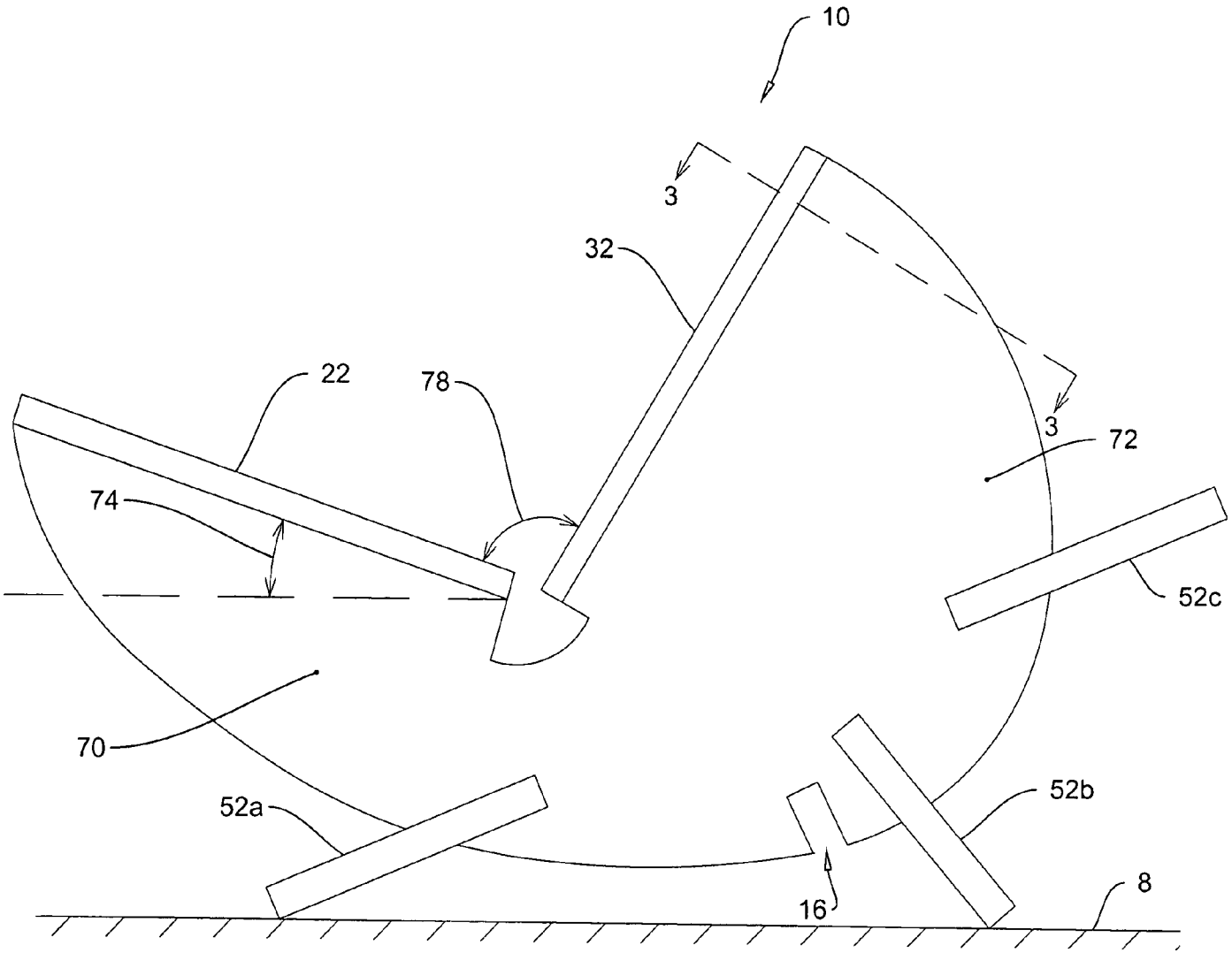
FIG. 2 is a side elevational view of the chair of FIG. 1.
Figure 6:
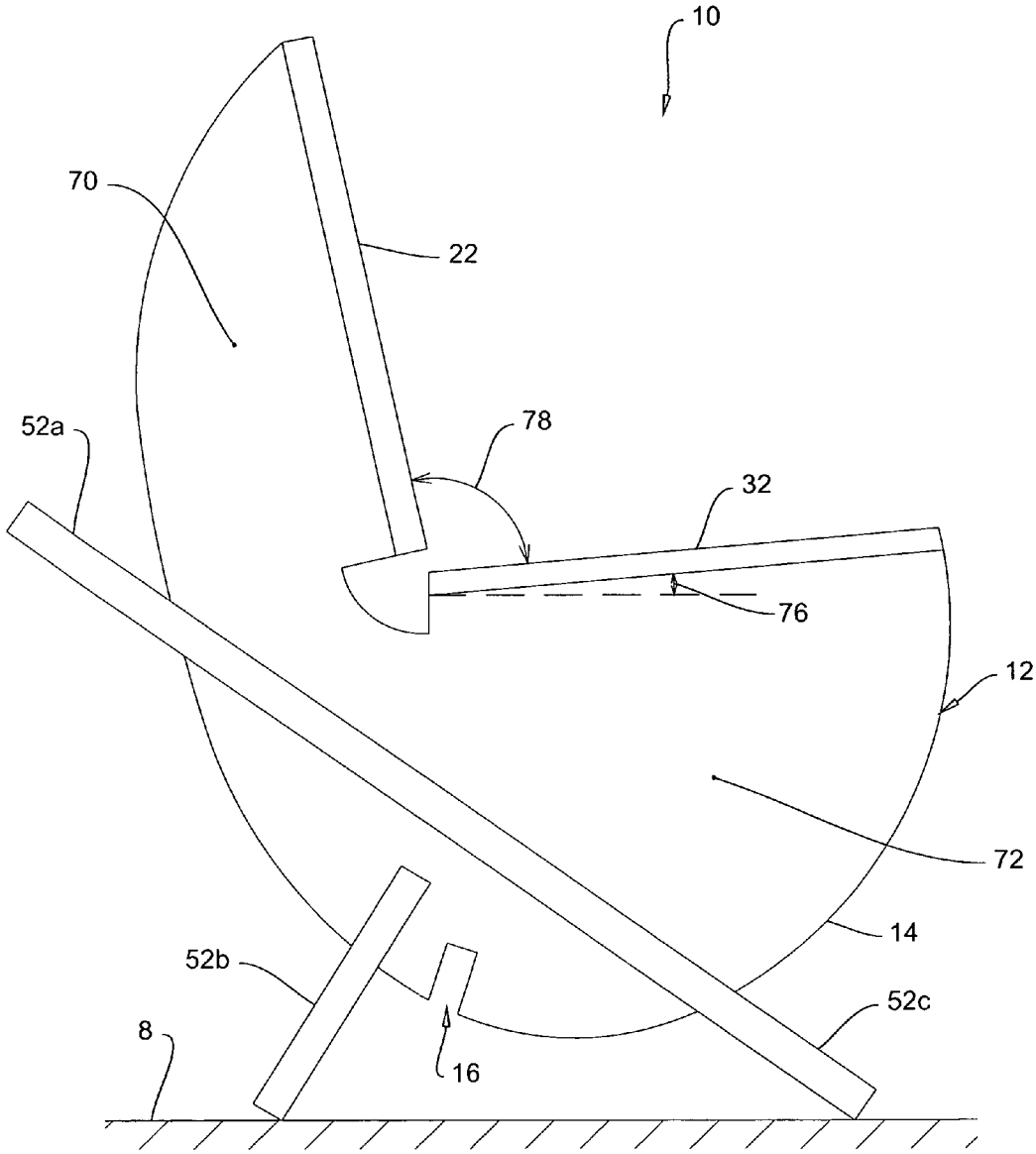
FIG. 6 is a side elevational view of the chair of FIG. 1 at a second orientation.

As illustrated, the chair 10 may include at least three base members 52*a*, 52*b* and 52*c*. A front base member 52*a*, a middle base member 52*b* and a rear base member 52*c*. The front and rear base members 52*a* and 52*c* may be affixed to the uprights 12 at fixed location whereas the middle base member 52*b* may be movable between one of a plurality of upright slots so as permit the chair to be oriented at first and second orientations as illustrated in FIGS. 2 and 6 and further explained below.

Figure 3:
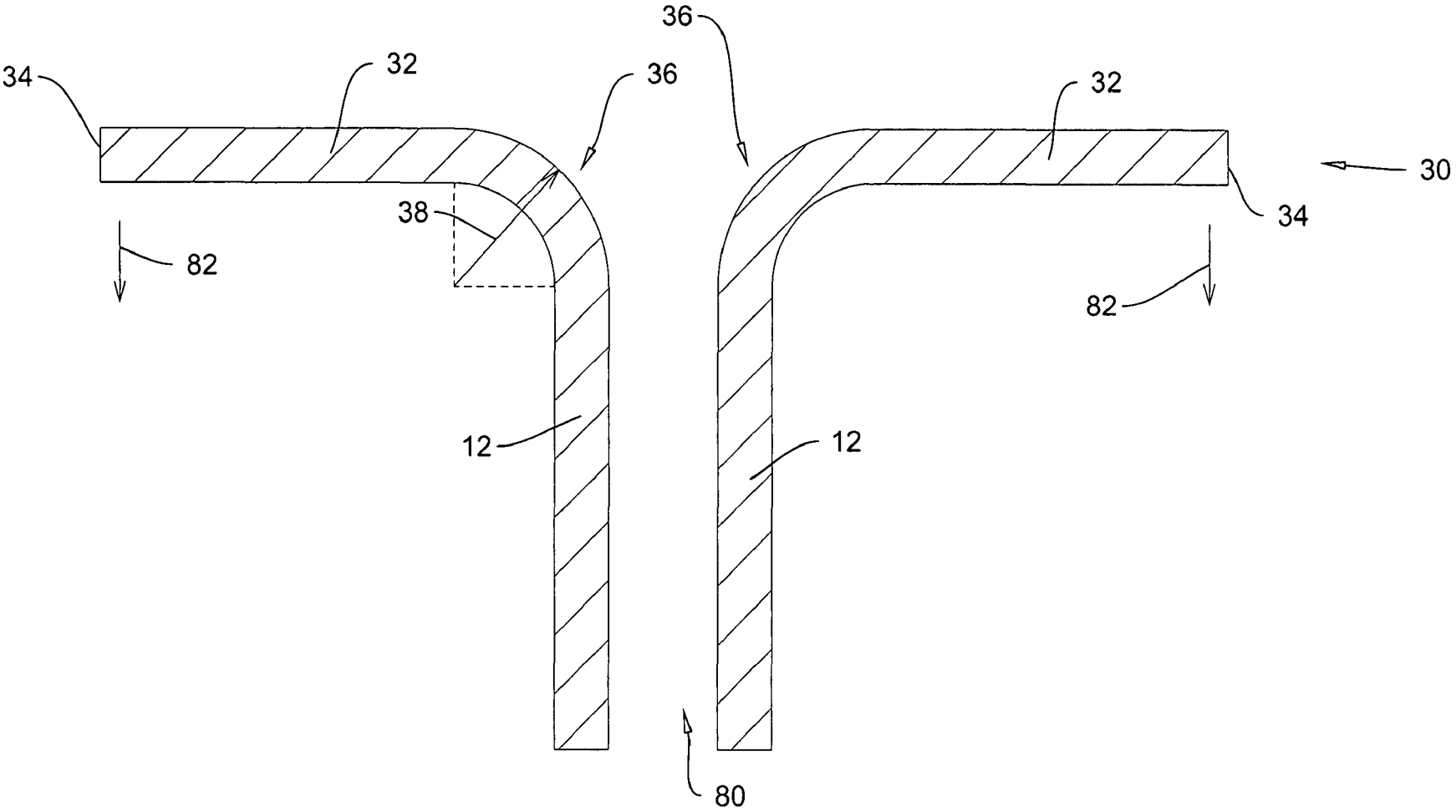
FIG. 3 is a cross-sectional view of the chair of FIG. 1 taken along the line 3-3.

With reference to FIG. 3, the back portion 30 is formed from a pair of substantially co-planar back members 32 or panels supported in cantilever fashion from a corresponding upright to a free distal end 34. The back members 32 may be substantially rectangular in outline as illustrated in FIG. 1, although it will be appreciated that other outline shapes may be utilized as well depending upon the appearance desired by the user, such as by way of non-limiting example, oval, circular, triangular, heart shaped, or irregular. The back members 32 are illustrated as being substantially planar, however it will be appreciated that the back members may also be curved or include some contouring may be provided corresponding to the back of a user.

As illustrated in FIG. 3, each back portion 30 may be continuously formed with the uprights 12. In such embodiments, the back portion 30 and upright may include a curved portion 36 therebetween having a radius of curvature at the surface that is to support the user indicated generally at 38. The radius of curvature 38 may be varied as desired by a user from between 0.4 and 2.4 inches (10 and 60 mm) with a radius of between 1.2 and 2 inches (30 and 50 mm) being particularly useful.

As illustrated in FIG. 1, the seat portion 20 may also be formed from a pair of substantially co-planar seat members 22 or panels supported in cantilever fashion from a corresponding upright to a free distal end 24. The seat members 22 may be substantially rectangular in outline as illustrated in FIG. 1, although it will be appreciated that other outline shapes may be utilized as well depending upon the appearance desired by the user, such as by way of non-limiting example, oval, circular, triangular, heart shaped, or irregular. The seat members 22 may be formed integrally with their corresponding upright at a curved portion 26 in a similar fashion to the back members 32 and described above with reference to FIG. 3.

Also as illustrated in FIG. 3, the uprights 12 include a spacing therebetween corresponding to a location of the user's spine generally indicated at 80. In particular, the uprights may be spaced apart by a distance of between 0.4 and 3.2 inches (10 and 80 mm) as desired by a user and depending upon the radius of curvature so as to maintain the curved portions 36 to either side of the spine of a user. As illustrated, the spine gap 80 is positioned along a central axis of the chair so as to receive the spine of the user therein. In operation, a user sitting on the chair will be positioned such that their spine is received within the spine gap 80 so that no pressure is exerted directly upon their spine by the chair. Additionally, in such use, it will be observed that the curved portions 36 of the back members 32 are located to engage upon and massage the long muscles to either side of the spine of the user. In operation, a user sitting on the chair 10 will exert a force upon the back members 32. This will cause each back member 32 to be deflected away from the back in a direction generally indicated at 82. As the back members 32 are deflected away from the back of the user, the curved portion 36 will be maintained as the closest point of contact with the user's back thereby serving to maintaining the curved portion 36 in contact with the long muscles along the user's spine.

The chair 10 may be orientable to a plurality of positions so as to support a user in one of a plurality of seating positions. By way of example, as illustrated in FIG. 2, the chair may be orientable to a first orientation. In the first orientation, the seat members 22 are substantially horizontal to provide a seating surface for a user and the back members 32 are upright to as to provide a back support for the user. In such an orientation, the first and second base members 52*a* and 52*b* support the chair. Turning now to FIG. 6, a second orientation is illustrated in which the back members 32 are substantially horizontal so as to now provide a seating surface for a user and the seat members 22 are upright so as to provide a back support for the user. In such an orientation, the second and third base members 52*b* and 52*c* support the chair. It will be observed that the second base member 52*b* is utilized to support the chair 10 in either the first or second orientation. It will also be observed that in either the first or second orientation, the second base member 52*b* is located in a different upright slot 16. Accordingly, during the course of repositioning the chair between first and second orientations, the second base member 52*b* may be moved to the appropriate upright slot for that orientation.

Each of the uprights 12 have first and second portions 70 and 72, respectively. The first portions 70 are connected to the seat members 22 and the second portions 72 are connected to the back members 32. As illustrated in FIGS. 2 and 6, the first portion 70 is sized to have a shorter height than the second portion 72. Accordingly, when the chair is oriented to the second orientation as illustrated in FIG. 6, the back members 32 which in this orientation for a seating surface for a user will be spaced apart from a floor 8 or other ground surface by a distance that is greater than the seat members 22 are spaced apart from the floor 8 when the chair is oriented in a first position as illustrated in FIG. 2. By way of non-limiting example, in the second orientation, a leading edge of the back members 32 may be spaced apart from the floor by a distance of between 15.7 and 23.6 inches (400 and 600 mm). Similarly, the seat members 22 may be spaced apart from the floor by a distance of between 11.8 and 15.7 inches (300 and 400 mm).

In the first orientation, the seat members may be oriented relative to the floor 8 by a first tilt angle, generally indicated at 74 so as to angle the seat members 22 at a rearward incline so as to present a more relaxing seating position for the user. The first tilt angle 74 may be selected to be any angle desired by a user, such as by way of non-limiting example between 20 and 40 degrees with an angle of between 20 and 30 degrees being particularly useful. Similarly, in the second orientation, the back members 32 may be angled relative to the floor 8 when the chair is in the second orientation by a second tilt angle generally indicated at 76 as illustrated in FIG. 6. The second tilt angle 76 may be selected to be between 0 and 30 degrees with an angle of between 10 and 20 degrees being particularly useful. The seat members 22 and back members 32 have an opening, generally indicated at 78 therebetween. The opening angle 78 may be selected according to the preferences of a user, such as by way of non-limiting example 95 and 110 degrees, with an angle of 100 degrees being found to be particularly useful for maintaining good posture between the back and hips of the user.

In an optional embodiment the first and third base members 52*a* and 52*c* may be formed of a continuous member as illustrated in FIG. 5. Optionally, the first and third base members 52*a* and 52*c* may be permanently secured to the uprights in such an orientation.

The materials utilized to form the chair may be of any suitable type including, without limitation, metals, woods and plastics. Although the above materials are provided for example purposes only, it will be appreciated that many other materials may also be suitable. The materials utilized to form chair may also be of any color as desired by a user.

The chair may be formed by providing a planar sheet of material cut to the outline of the uprights 12 and the back and seat members 32 and 22. The sheet of material may then be plastically deformed, such as by way of non-limiting example, thermoforming so as to bend the back and seat members 32 and 22 about the back and seat curved portions 36 and 46 until the back and seat member 32 and 22 are aligned perpendicularly to the uprights. In such forming processes, the material may be selected from formable material such as, by way of non-limiting example, polyvinyl chloride (PVC), polyethylene, (PE), polycarbonate, cellulose acetate, acrylonitrile butadiene styrene (ABS), or acrylic. In other methods of forming the chair, laminated wood, such as plywood by way of non-limiting example may be and formed by way of known wood forming methods. Optionally, the uprights, back and seat members may be cast or otherwise molded into the desired shape.

It will be appreciated that although the chair 10 is described above as being formed of substantially rigid and hard materials, the seat and back members 22 and 32 may also have a cushioning surface applied thereto or incorporated therein. Non-limiting examples of such cushioning surfaces includes, rubbers, foam rubber, leather, fabric and the like.

While specific embodiments of the invention have been described and illustrated, such embodiments should be considered illustrative of the invention only and not as limiting the invention as construed in accordance with the accompanying claims.

What is claimed is:

1. A chair comprising:

a seat;

a base;

a pair of parallel spaced apart uprights extending from said base positioned to opposed sides of the spine of a user seated on the chair, said uprights supporting said seat; and a first substantially planar body support member integrally formed and extending from each upright in opposed directions to a free distal end, said first body support members being substantially parallel to the back of said user, wherein each first body support member and upright have an arcuate portion therebetween having a radius of curvature of between 0.4 and 2.4 inches at a surface that supports a user.

2. The chair of claim 1 wherein said uprights comprise vertical plates.

3. The chair of claim 1 further comprising a pair of first body support members and a pair of second pairs of body support members angularly oriented relative to said first body support members.

4. The chair of claim 3 wherein said first pair of body support members form a seat portion and said second pair of body support members form a back support for said user.

5. The chair of claim 4 wherein said uprights and first and second body support members are rotatable between first and second orientations, in said first orientation said first body support member forms a seat and said second body support members form said back of said chair, in said second orientation said second body support members form a seat and said first body support members for said back of said chair.

6. The chair of claim 4 wherein said first and second body supports have an angle of 100 degrees therebetween.

7. The chair of claim 1 wherein said base comprises planar members oriented perpendicularly to said uprights.

8. The chair of claim 7 wherein said base comprises a first set of legs for supporting said chair in said first position orientation and a second set of legs for supporting said chair in said second position orientation.

* * * * *